US006923773B2

(12) United States Patent
Leivseth et al.

(10) Patent No.: US 6,923,773 B2
(45) Date of Patent: Aug. 2, 2005

(54) DEVICE FOR VIBRATORY STIMULATION ON THE HUMAN BODY

(75) Inventors: Gunnar Leivseth, Trodheim (NO); Ole Olsen, Langesund (NO)

(73) Assignee: Arctic Medical AS, Trondheim (NO)

( * ) Notice: Subject to any disclaimer, the term of this patent is extended or adjusted under 35 U.S.C. 154(b) by 173 days.

(21) Appl. No.: 10/465,392

(22) Filed: Jun. 20, 2003

(65) Prior Publication Data

US 2004/0068211 A1 Apr. 8, 2004

Related U.S. Application Data

(63) Continuation of application No. PCT/IB02/00012, filed on Jan. 7, 2002.

(51) Int. Cl.[7] ..... A61H 1/00
(52) U.S. Cl. ..... 601/27; 601/28
(58) Field of Search ..... 601/24, 26, 27–28

(56) References Cited

U.S. PATENT DOCUMENTS 4,200,282 A * 4/1980 Agyagos ..... 482/147
5,018,510 A 5/1991 Slater
5,046,485 A 9/1991 Slater
5,484,388 A * 1/1996 Bassett et al. ..... 601/27
6,010,432 A * 1/2000 Vawter ..... 482/54
6,626,411 B2 * 9/2003 Houghton et al. ..... 248/550

* cited by examiner

*Primary Examiner*—Michael A. Brown

(57) ABSTRACT

A device for vibratory stimulation on the human body comprises a support platform, a panel supported by the platform and forming a standing surface for a person using the device, and a vibrator for imparting to the panel a vibratory movement. Two standards are mounted to the platform at opposite sides of the panel, forming handles for the person standing on the standing surface between the standards to hold on. A sensor is provided for sensing the load on the panel or on the standards exerted by the person standing on the standing surface. A control unit is connected with the sensor and the vibrator for controlling the operation of the vibrator in dependence on the load sensed by the sensor.

5 Claims, 1 Drawing Sheet

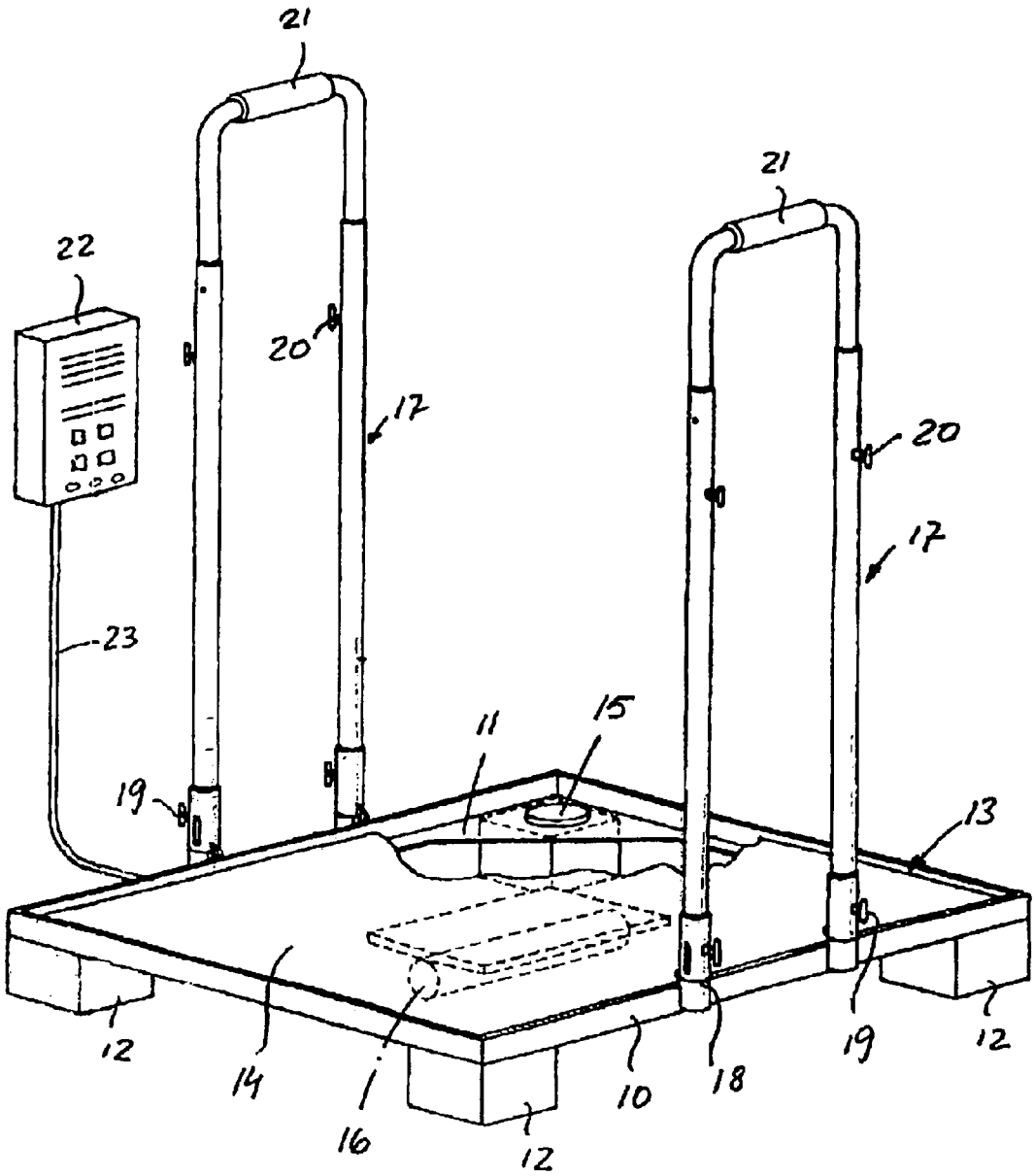
21
21
22
20
17
20
17
23
11
15
19
13
12
14
16
12
10
18
19
12

DEVICE FOR VIBRATORY STIMULATION ON THE HUMAN BODY

This application is a continuation of PCT/IB02/00012 filed Jan. 7, 2002.

BACKGROUND OF THE INVENTION

1. Field of the Invention

This invention relates to a device for vibratory stimulation on the human body.

2. Description of the Prior Art

The therapeutic effect of vibratory stimulation on the human body has been well documented. Vibration at low frequencies applied to tissue increases blood circulation due to the increase in capillary dilation. The increased blood flow increases the consumption of oxygen and nutrients by muscles and improves the regeneration process. The result is an improved muscular tone, elasticity and contractile capacity.

A prior art device for vibratory stimulation on the human body is marketed under the trade mark PowerPlate™ by Power Plate International, 1181 RP Amstelveen, The Netherlands, comprising a support platform, a panel supported by said platform and forming a standing surface for a person using the device, a vibrator for imparting to said platform a vibratory movement, a standard on the platform for the person standing on the standing surface to hold on, and a control unit for the vibrator.

In the prior art device the standard is located centrally in front of the panel, and the control unit for the vibrator is mounted at the upper end of the standard, where also two laterally projecting handles for the person using the device are provided.

The prior art device can be used for rehabilitation and training therapy and provides a neuro-mechanical vibratory stimulation which is very effective and acts on substantially all tissues and structures in the human body such as neuro-muscular systems, circulation, bone structure, hormone system, and neuro transmitters. This influence on the human body provides in a short period of use a considerable increase of the dynamic muscle strength, improved blood circulation, increased fat combustion etc.

Other prior art devices which provide vibratory stimulation are marketed by S. A. I. R., Italy, under the trade mark NEMES™ and by Novotec, Germany, under the trade mark Galileo™.

The prior art devices mentioned above all have in common that they are relatively heavy, expensive and not easy to disassemble and stow away. The prior art devices have no force measuring ability.

U.S. Pat. No. 5,018,510 and U.S. Pat. No. 5,046,485 each disclose a scale with a vibrator.

BRIEF SUMMARY OF THE INVENTION

A primary object of the invention is to provide an improved device for vibratory stimulation on the human body, which allows a more individual adaptation of the vibratory effect to the constitution of the person using the device.

A further object of the invention is to provide a device of the kind referred to which can be collapsed or disassembled in order more easily to be stored away and transported.

These and other objects which will be apparent from the description which follows are achieved by a device for vibratory stimulation on the human body which according to claim 1 comprises a support platform, a panel supported by said platform and forming a standing surface for a person using the device, at least one sensor for sensing the load on the panel exerted by the person standing on the standing surface, a vibrator for imparting to said panel a vibratory movement, and a control unit for the vibrator, and is characterized in that two standards are provided on the platform at opposite sides of the panel, forming handles for the Person standing on the standing surface between the standards to hold on, which allow the person to increase and decrease the load transferred to the panel by the person standing on the standing surface, and that the control unit is connected with said at least one sensor and said vibrator for controlling the operation of the vibrator in dependence on the load sensed by said at least one sensor.

Said at least one sensor can be located between the support platform and the panel to measure the force acting on the platform, or a sensor can be located in each of the two standards to measure the force acting on the standard.

Advantageous further details of the device of the invention are defined in the dependent claims.

BRIEF DESCRIPTION OF THE DRAWING

The accompanying drawing discloses a perspective view, partly cut away, of an illustrative embodiment of the device of the invention.

DETAILED DESCRIPTION OF THE INVENTION

The device for vibratory stimulation on a human body disclosed in the drawings comprises a rectangular frame 10 of angle bars one flange of the angle bars being horizontal and the other flange projecting vertically therefrom. At the corners triangular metal sheets 11 are connected as by welding with the horizontal flanges. A parallelepipedic block 12 of a vibration attenuating material such as rubber or another elastic material is attached to the lower side of each metal sheet 11 the four blocks forming supporting feet for the frame.

A rectangular panel 13 forming a plane standing surface 14 for the person using the device is congruent with the frame 10 and is located within the vertical flanges of the frame and is supported by the horizontal flanges of the frame. However, at least one force sensor is located between the panel and the frame, preferably a force sensor 15 is mounted on the upper side of each metal sheet 11, and the panel 13 rests on these force sensors which can be of any suitable type well known in the art.

Frame 10 and panel 13 are not necessarily rectangular. They can have another shape such as oval or circular.

A vibrator 16 which can comprise an electric motor with an unbalanced weight on the shaft thereof or can be of any other suitable type known in the art is mounted to the lower surface of the panel in order to vibrate the same.

Two standards 17 are mounted to the frame 10 at opposite sides of the panel 13, and these standards consist of U-shaped bows. The limbs of the bows are mounted to the frame by means of hinges 18 that allow the standards to be collapsed against the platform, or by connections that allow the standards to be easily disassembled so that the device can easily be stowed away or transported. Means 19 are provided in order to securely lock the standards in the vertical upstanding position shown in the drawing. The limbs are of telescopic construction so that the length thereof can be adjusted, and means 20 are provided in order to securely lock the standards in the adjusted position. Said means 19 and 20 can comprise e. g. screw clamps, spring biased pins engaging matching apertures, or lock means of any other suitable type. At the top each standard is provided with a handle 21 which can be connected to the standard via flexible vibration damping connections, e. g. of rubber, so that vibrations travelling from body to platform, and vice versa, via the arms of the user are minimized.

A control unit 22 is connected by a cable 23 with the vibrator 16 for controlling the operation thereof, and with the force sensor 15 or each of the force sensors, respectively, for receiving signals representing the load on the platform as measured by the sensor.

It is well known that the effect of the vibration on the human body is dependent of the frequency, amplitude, muscle tension, and duration of the vibration, and the control unit shall be constructed for variation of these quantities and for shutting the vibrator on and off manually and also in dependence of the sensed load on the platform.

When the described device is to be used the standards 17 are locked in the upright position and the length thereof is adjusted in order to match the tallness of the person who is going to use the device, and are locked in the adjusted position. The person is standing on the standing surface 14 of the panel 13 holding on the handles 21. The standards 17 are used for holding the body in a desired position with the legs bent at a desired knee angle. The weight of the person standing on the standing surface is the load on the panel and will be indicated by the sensor or sensors. However, the standards can be used for adjusting the loading on the panel. If the person standing on the standing surface of the panel pulls the standards and tensions the musculature the loading on the panel will be increased and will be greater than the body weight. If the person pressures against the standards the loading on the panel will be reduced and will be less than the body weight. It is thus possible to train by vibration under "negative" and "positive" loading.

The vibrator is shut on either manually by means of a switch on the control unit, or by means of a photocell which senses the presence of a person on the panel, and can be started in different manners:

The vibrator is started when the body weight is indicated.

The vibrator is started at indication of a weight which is higher than the body weight.

The vibrator is started at indication of a weight which is lower than the body weight.

The loading value at which the vibrator is to be started is set by the training person on the control unit, and the vibrator will be automatically stopped if the loading decreases under the value which has been set. An adjustable time delay can be added, so that the person has time to take the proper position after the set force has been achieved, before start of the vibration. The duration of the vibration as well as the frequency and amplitude thereof are also set on the control unit which automatically stops the vibration after the duration set on the control unit has lapsed.

The embodiment described is illustrative only. Other embodiments and modifications can be proposed by the skilled man within the scope of the invention as defined in the appended claims. For example, sensors 15 between frame 10 and panel 13 can be replaced by a force-sensing device of the same type as that used in bathroom scales, which comprises a supporting platform with a force transducer integrated therewith according to known technique. Frame 10 supporting the panel which can be integrated with the frame without intermediate sensor(s) is supported on the platform by the feet 12. In this case a reliable load sensing can be achieved by means of a single force transducer in the supporting platform. Standards 17 are attached to the supporting platform and not to the frame.

In a further embodiment force sensors 15 between support frame 10 and panel 13 can be replaced by a force sensor in each standard 17 in order to measure not the weight of the person using the device but only the force transmitted to the standards by a person standing on the platform when said person pulls the standard or pressures against the standards, respectively. In this case the vibrator can be controlled in an analogues manner as described above in dependence of the force exerted on the standards by the person standing on the platform.

What is claimed is:

1. A device for vibratory stimulation on the human body, comprising:

a support platform;

a panel supported by the platform and forming a standing surface for a person using the device;

two standards on the platform at opposite sides of the panel for forming handles for the person standing on the standing surface between the standards to hold on, which allow the person to increase and decrease the load transferred to the panel by the person standing on the standing surface;

at least one sensor for sensing the load on the panel exerted by the person standing on the standing surface;

a vibrator for imparting to the panel a vibratory movement;

a control unit for the vibrator, the control unit being connected with said at least one sensor and said vibrator for controlling the operation of the vibrator in dependence on the load sensed by said at least one sensor.

2. The device according to claim 1, wherein said at least one sensor is located between the support platform and the panel to measure the force acting on the standard.

3. The device according to claim 1, wherein a sensor is located in each of the standards to measure the force acting on the standard.

4. The device according to claim 1, wherein the standards are mounted to be collapsed again the panel or be dissembled from the platform and to be locked in an upright position.

5. The device according to claim 1, wherein the height of the standards is adjustable.

* * * * *